US006170711B1

(12) United States Patent
Sherman et al.

(10) Patent No.: US 6,170,711 B1
(45) Date of Patent: Jan. 9, 2001

(54) PACKAGE CONTAINING DISPENSING DEVICE WITH MAGNET

(75) Inventors: Adam Sherman, Larchmont; Charles Craig Tadlock, Islip Terrace; Andrew J. Bevacqua, E. Setauket, all of NY (US)

(73) Assignee: E-L Management Corp., New York, NY (US)

( * ) Notice: Under 35 U.S.C. 154(b), the term of this patent shall be extended for 0 days.

(21) Appl. No.: 09/025,661

(22) Filed: Feb. 18, 1998

(51) Int. Cl.[7] ..... B67D 5/40; B65D 47/18

(52) U.S. Cl. ..... 222/192; 222/420; 222/464.6; 222/382

(58) Field of Search ..... 222/382, 464.1, 222/464.6, 420, 192; 141/24

(56) References Cited

FOREIGN PATENT DOCUMENTS 11019649 1/1999 (JP) .

*Primary Examiner*—Kevin Shaver
*Assistant Examiner*—David Deal
(74) *Attorney, Agent, or Firm*—Kenyon & Kenyon

(57) ABSTRACT

The present invention relates to a container for dispensing a fluid product, the container having a dispensing device on or within which is placed at least one magnet.

18 Claims, 5 Drawing Sheets

PACKAGE CONTAINING DISPENSING DEVICE WITH MAGNET

FIELD OF THE INVENTION

The invention relates to packaging containing magnets. More specifically, the invention relates to packages with dispensing devices which incorporate magnets.

BACKGROUND OF THE INVENTION

The biological effects exerted by magnets have recently become very widely recognized. It is now widely accepted that exposure to a magnetic field can have a positive benefit on a variety of different types of products and on the consumer using such products so treated. For example, WO 9503061 discloses a preparation containing magnetic particles, which preparation can have the effect of increasing blood circulation, thereby purportedly enhancing delivery of active components to target tissues, among other effects. Exposure to a magnetic field is also said to have the effect of preserving food or cosmetic products, preventing the decay of materials contained therein (JP 5309016). It is also said that cosmetic products so treated, when applied to skin, can produce a "regenerative" action on the skin(DE 3629761). It is apparent, then, that those skilled in the art recognize that that treatment of products with a magnetic field can have a beneficial effect on the product and the end user.

The desired exposure can be accomplished by a variety of different mechanisms. For example, this can be achieved by exposing the product to a magnet during the manufacturing process (ES 2083331). However, one of the more common means for treating a product with a magnetic field is to incorporate one or more magnets into the packaging in which the product is stored and/or sold. For example, the package may have a magnet or magnetizing device which is detachable (CN 1094685). More commonly, however, a package may have one or more magnets incorporated into the wall of the container, or permanently fixed on a surface of the container (e.g., WO 9709249, BR 9104783, JP 3176381, U.S. Pat. No. 5,297,694, FR 2649959, DE 3634121). One of the disadvantages of such systems, however, is that, with magnets fixed in place in the package, the product may not be continually and/or uniformly exposed to the magnetic field, potentially resulting in an inadequate magnetization of the product. For example, in a situation in which the magnets are located in fixed position on or within the inner wall of the container, as the amount of the product in the package is used up, the level drops, and may in fact drop below a point at which it has any effective exposure to the magnet. In addition, containers which contain magnets embedded in or affixed to their walls will require a somewhat more cumbersome, and therefore costly, process of manufacture than would a standard plastic or glass jar or bottle. There thus continues to be a need for magnetic packaging which provides consistent, strong exposure of the product to the magnetic field, while at the same time permitting a fairly simple, and inexpensive, method of manufacture. The present invention provides such a package.

SUMMARY OF THE INVENTION

The present invention relates to a container for holding a fluid product, the container comprising a dispensing device with a magnetic material positioned on or within the dispensing device. With product in the container, upon activation of the dispensing device, the product is drawn through or over the magnet immediately prior to actual dispensing, providing exposure to the desired magnetic field as close in time as possible to actual use by the consumer. The container of the invention can be used for conferring magnetic energy on a variety of products, including, but not limited to cosmetics, pharmaceuticals, agricultural and industrial chemicals, and foodstuffs.

DETAILED DESCRIPTION OF THE INVENTION

Figure 1:
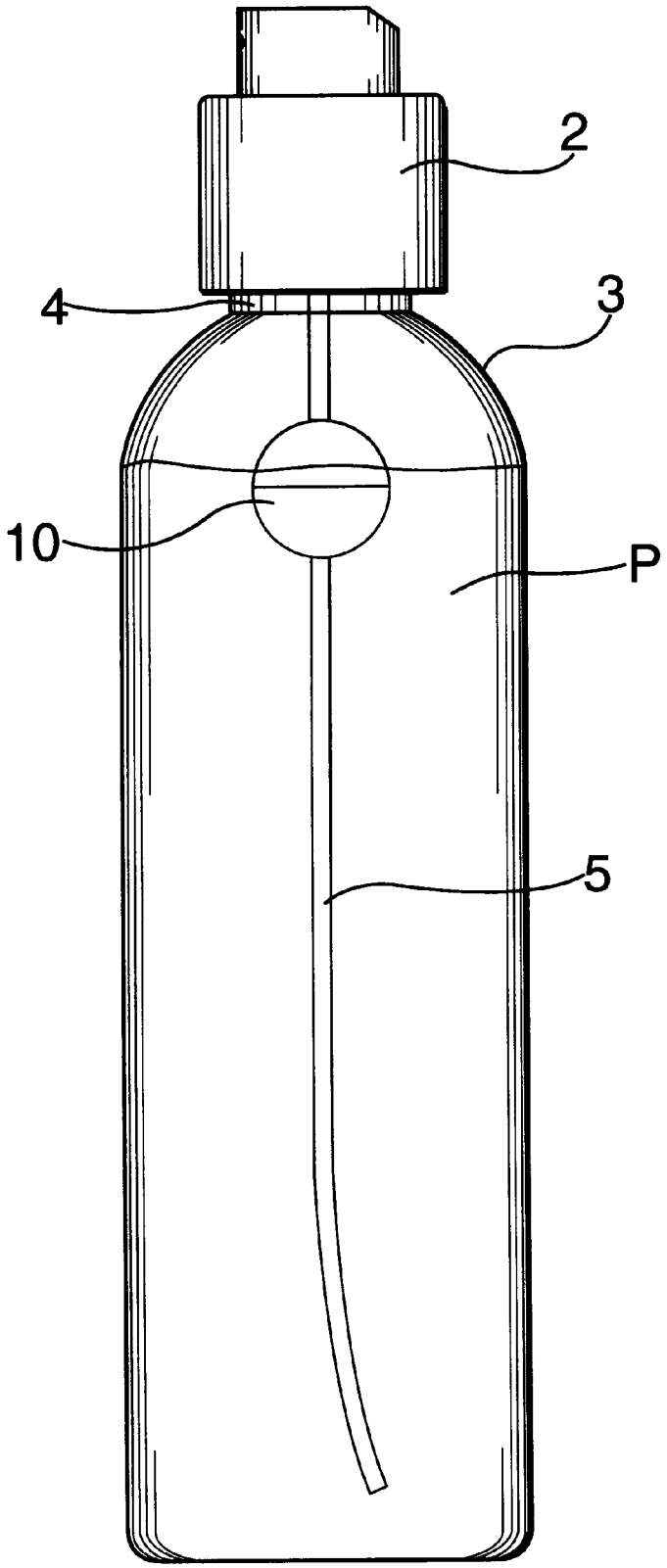
FIG. 1 illustrates a container of the invention in which a magnet, encased in a floating ball, is associated with the dip tube of a pump.

In the container of the invention, a magnet is positioned on or in the dispensing device of the package, so as to permit the product to be treated to flow over or through the magnet as it is leaving the container. This arrangement has the advantage of concentrating the magnetic field, as well as providing the fluid product intimate contact with the magnet as it is drawn from the container, thereby permitting optimum exposure to the magnetic energy just prior to use. This obviates the problems attendant on the use of magnets in fixed position on or in the wall of the container, where contact of the fluid with the magnet may be limited by the positioning of the magnet.

The dispensing device can be of any type, and the magnet may be placed in any position on the device, provided that the positioning allows the fluid being dispensed to contact the magnet immediately before leaving the package. For example, in a container with a pump-type dispensing device, the magnet may be positioned directly adjacent to or on the dip tube of the pump. On the dip tube, the magnet may be in a number of different configurations, which include, but are not limited to, a cylinder or bar magnet surrounding the dip tube, a magnet coiled around the dip tube, a washer or ring magnet around the base of the pump just above the dip tube, ring magnets directly surrounding the dip tube, a magnetic strip on the dip tube, or a dip tube which is itself formed from a magnetic metal. As can be seen from the foregoing examples, in certain configurations, the magnet may even be completely immersed in the fluid within the container.

In another embodiment, the container is one which has a strainer cup as a dispensing device. In this case, the magnet may be suspended from, or otherwise attached to, the base of the strainer cup, extending down into the fluid in the container. Suitable configurations for this type of dispenser are a cone-shaped magnet, a magnetic ball, ring or hoop suspended from a rod attached to the strainer cup, a horseshoe-shaped magnet, or a rectangular paddle or rod magnet.

In a third embodiment, the dispensing device is a dropper assembly. In this example, the magnet may take any convenient form, including, but not limited to, a rod, bar, coil, or spiral, which is suspended within the dropper itself. The magnet may be attached to the dropper assembly, or it may simply float within the tube of the dropper.

In any of the foregoing embodiments, it is preferred that the magnet be coated or encased in a layer of polymer, to prevent any undesirable interaction between the metal of the magnet and the fluid contents of the container. Such a coating may be particularly important in embodiments in which the magnet is actually immersed in the fluid product. The coating will to a large extent be chosen so as to be compatible with the fluid product. Examples of coatings which will be compatible with a wide variety of possible products include, but are not limited to, PVC, PET, polyester, SAN or vinyl or in addition to providing a protective effect, however, the coating can also provide a functional advantage. For example, in the dip tube magnet embodiment, the plastic coating may be expanded to take the form of a "float" encasing the magnet. Details of such an arrangement are provided in Example 1. In brief, the plastic casing can take the form of a substantially hollow ball or cube, with a central bore capable of fitting over the dip tube, and a recess holding one or more magnets. In position in the container, the float is slidably disposed on the dip tube, so as to be able to float on or just beneath the surface of the fluid in the container, and to move down the tube as the level of fluid in the container diminishes. In this way, not only does the fluid contact the magnetic field as it exits through the tube, but the magnet is also always in direct contact with the fluid when the pump is not in use, since the level of the magnet lowers with the level of the fluid.

Any magnetic material can be used as the magnet in the present invention. Examples of useful magnetic materials include, but are not limited to, iron, aluminum, nickel, or cobalt compounds, or combinations thereof, or ceramic magnets. The strength of the magnet can be varied to suit the level of magnetizable material in the product of interest.

The invention can be applied to any container, of any shape, designed to carry fluid products which can benefit from the application of magnetic energy. By "fluid" products is meant any product the viscosity of which is sufficiently low to permit it to be drawn through a dispensing device such as a pump or dropper; thus, this encompasses fluid material having the viscosity of water as well as products such as creams or lotions. The product may be aqueous, anhydrous, water-in-oil or oil-in-water. The only requirement is that it must contain a magnetizable component. Thus, the use of deionized or distilled water is not recommended.

In a particularly preferred embodiment, the container of the invention is used for a cosmetic product. Although, as noted above, magnetization of a product can provide a preservative effect, and therefore is useful for virtually any type of product, a particular advantage is seen in the treatment of products to be applied to the skin. It has been observed that exposure of water, or a cosmetic containing water, to a magnetic field prior to use on the skin, results in improved moisturizing properties of the water or cosmetic so treated, without the further addition of more moisturizers, which may make the product feel greasy or heavy. Thus, the presence of a magnet on the dispensing device of a cosmetic product provides a means by which one can enhance the moisturizing properties of the cosmetic, without increasing the complexity of the formulation. The cosmetic in question can be any type, for example, a treatment product, such as a moisturizer, a skin soother, a cleanser, a wrinkle treatment, a sunscreen, self-tanner, and the like; or a makeup product, such as a foundation, concealer, eyeshadow, blush, or lip product. The invention will be further understood by reference to the following non-limiting examples.

EXAMPLES

Example 1

This example describes a container with a pump having a magnet placed on the pump's dip tube.

Referring to the drawings, FIG. 1 shows a complete package wherein the dispensing portion of the container is a pump 2. A container is provided which houses a product P. The container has a neck 4 with an opening, said opening providing access to product P. The neck is provided along its outer surface with a means to secure a pump to the container. The means utilized to secure a pump to a container are numerous and well known in the art. Such means include opposing threads, lug-style engagements, snap-fit engagements, crimping engagements, and the like.

The pump 2 contemplated for use with the present invention can be any standard type of pump which utilizes a dip tube 5 for dispensing of the product. Such pumps are available from, for example, Pfeiffer of America, (Princeton, N.J.) The dip tube 5 of the present invention is a hollow tube which extends from the pump 2, through the neck, and into the container 3. The dip tube serves to connect the pump to the product P so that the product can be dispensed easily.

Figure 2:
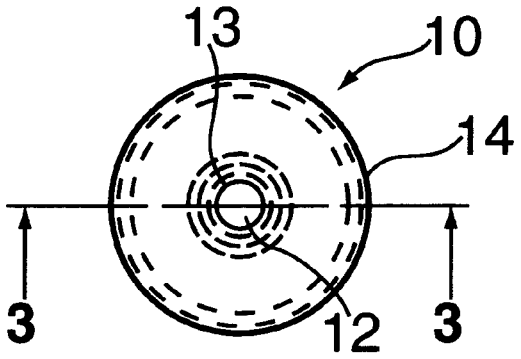
FIG. 2 illustrates a top view of the floating ball of FIG. 1.
Figure 3:
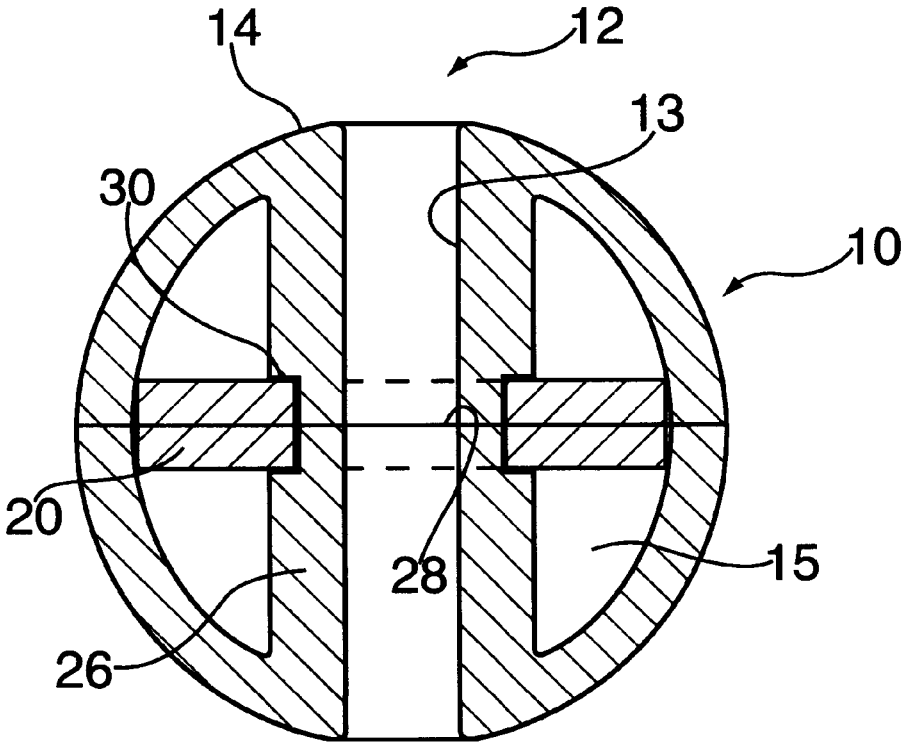
FIG. 3 illustrates a side cross-sectional view of section A—A of FIG. 2.

Slidably disposed about the dip tube 5 is a casing 10. The casing is designed to float at or just below the level of the product within the container. In other words, when viewing the container 3, the casing 10 will be visible atop the product P, and because the casing is slidably disposed about the dip tube 5, the casing 10 will slide along the longitudinal axis of the dip tube as the product level decreases with consumer use. To permit the casing 10 to float atop the product and slide along the dip tube 5, the casing is molded as a hollow article with a central aperture 12, as seen in FIGS. 2–3, said aperture 12 having a wall 13 which engages the outer surface 14 of the casing 10 at either end of the aperture 112, thus forming an isolated internal chamber 15 within the casing.

Fitted within the internal chamber 15 of the casing 10 are one or more magnets 20. The internal chamber 15 is designed to encapsulate the magnet 20 so that it does not come into contact with the product P. In some cases, it may be important to isolate the magnet from the product because the product will not be compatible with the magnet, and any contact between the two could possibly degrade the product or the magnet.

In order to place the magnet 20 within the internal chamber 15 of the casing 10, the casing 10 is formed in two halves, 21 and 21'. Each half of the casing has an outer surface 25 and 25' and a centrally located hub 26 and 26', each hub 26 and 26' having an axial bore 27 and 27' therethrough. Provided on the inner end 28 and 28' of each hub 26 and 26' is a recess 30 and 30'. The recess 30 and 30' is designed so as to secure a magnet 20 within the casing 10. For example, when the magnet 20 is "O" shaped, the inner end 28 and 28' of the hub will be provided with a recess which allows the center hole 23 of the magnet 20 to fit about said recess, as seen in FIG. 3.

Figure 4:
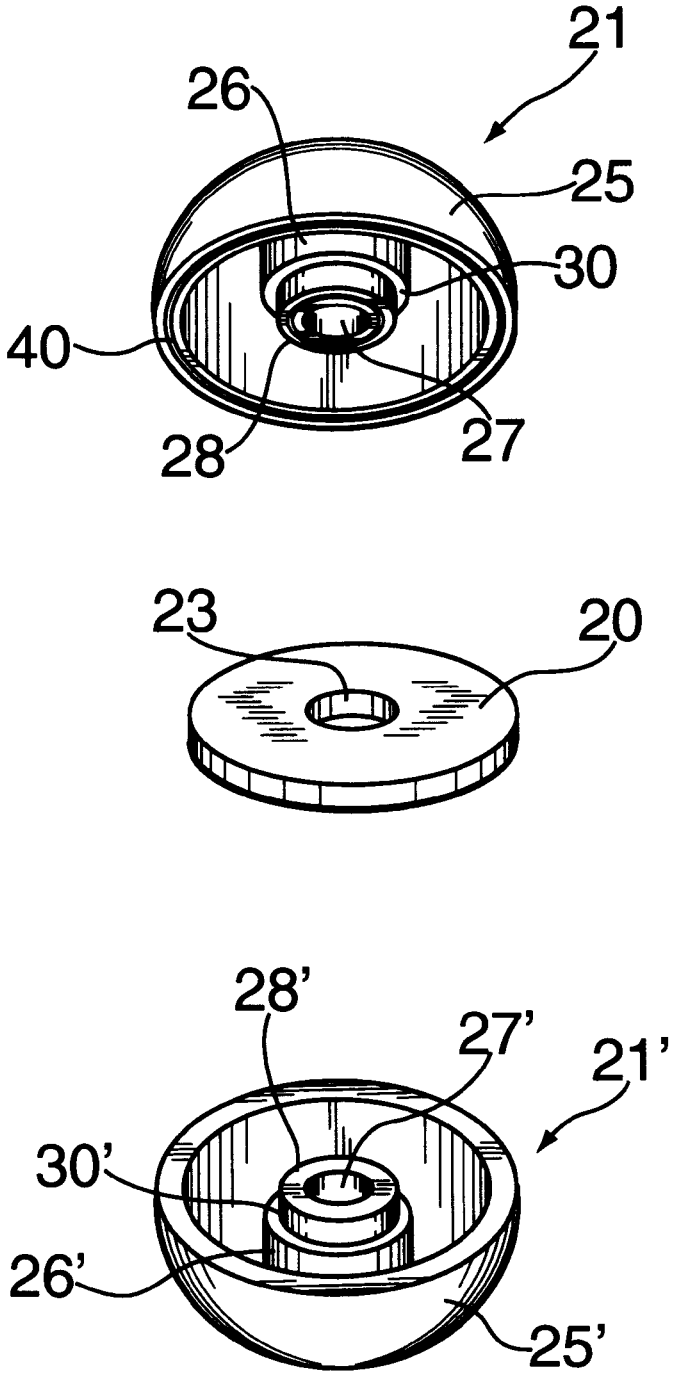
FIG. 4 illustrates an exploded view of the floating ball and its magnet.
Figure 5:
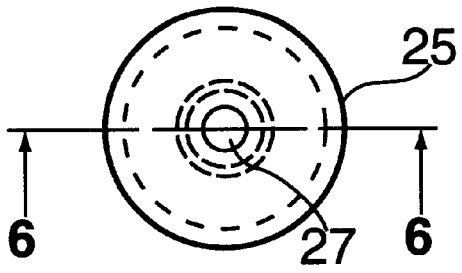
FIG. 5 illustrates a to view of one half of the floating ball without an enclosed magnet.
Figure 6:
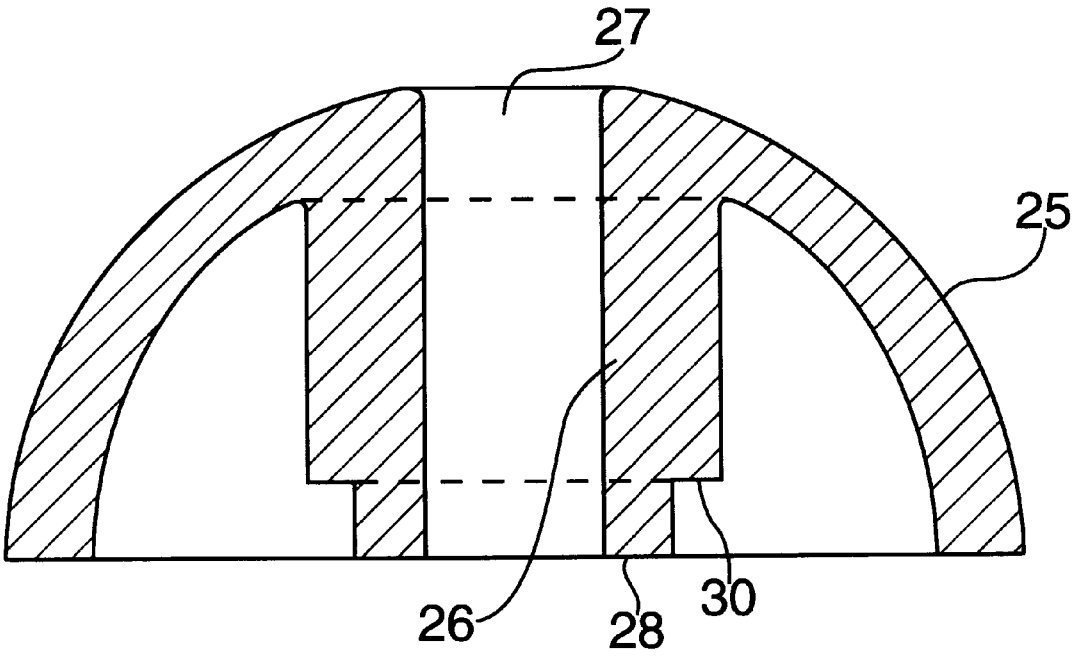
FIG. 6 illustrates a side cross-sectional view of section A—A of FIG. 5.

To assemble the casing 10 with the magnet 20 contained therein, first, the two halves 21 and 21' of the casing 10 are molded out of a suitable material, such as SAN or polyester. Next, the magnet 20 is placed on a recess 30 or 30', and then the two halves 21 and 21' of the casing 10 are sealed together, thus trapping the magnet 20 within the internal chamber 15 of the casing 10. The two halves 21 and 21' of the casing 10 are joined to each other by any appropriate method, such as sonic sealing, friction, adhesives or a snap fit. FIG. 4 shows the two halves 21 and 21' ready to be joined together by sonic sealing. With this method, one of the casing halves is provided with a sealing bead 40.

Once the two halves 21 and 21' of the casing 10 are joined together, each axial bore 27 and 27' and each centrally located hub 26 and 26' meet to form the central aperture 12 and wall 13, respectively, of the casing 10. Then, the casing 10 is placed onto the dip tube 5 of the pump 2, which is inserted into the container after the container is filled.

The magnet 20 used within the casing 10 is designed so that a magnetic field is concentrated on the dip tube 5, and thus, on the product P, as it flows through the dip tube 5. A useful magnet for the present purpose is a sintered Alnico 5 magnet(82 gauss; Dexter Magnetic Materials Division, Hicksville, N.Y.) Preferably, the magnet is "O", or "doughnut" shaped so that it can be easily placed within the casing and about the recess. Also, the magnet emits a magnetic field into the product in the container, because the outer surface of the casing is in contact with the product.

Example 2

Figure 7:
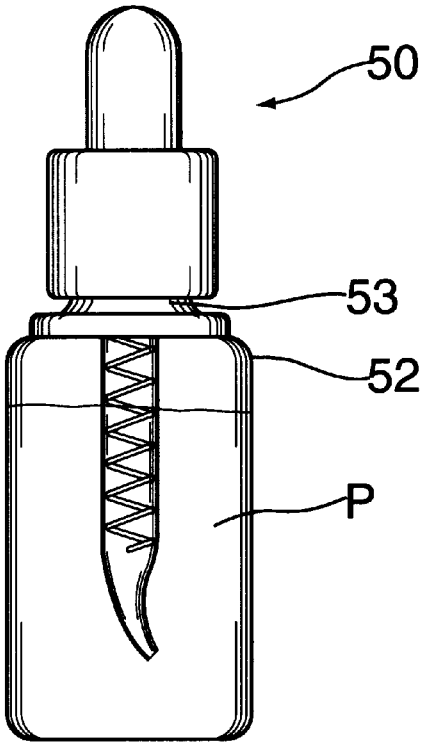
FIG. 7 illustrates a container of the invention in which a magnet is inserted into the tube of a dropper assembly.

An alternate embodiment of the present invention is shown in FIG. 7. In this embodiment the dispensing portion of the container is a dropper assembly 50. A container 52 is provided which houses a product P. The container has a neck 53 with an opening, said opening providing access to product P. The neck 53 is provided along its outer surface with a means to secure the dropper assembly 50 to the container 52. The means utilized to secure the dropper assembly to the container 52 are typically opposing threads, but any other means which allow the dropper to be placed on and removed from the container can be used, such means being known in the art.

Figure 8:
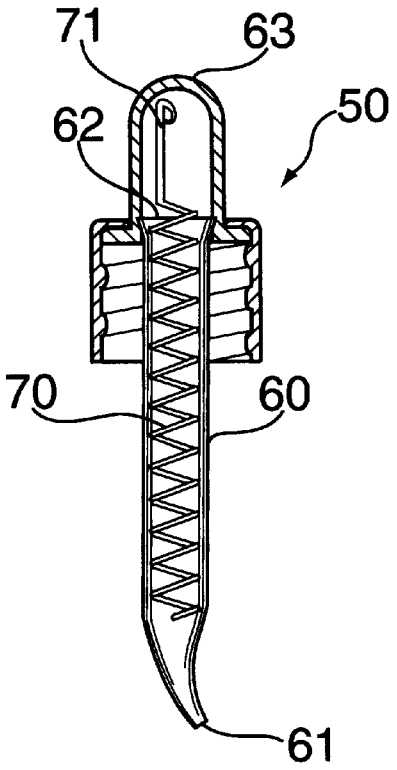
FIG. 8 illustrates an internal view of the dropper assembly of FIG. 7.

As seen in FIG. 8, the dropper assembly 50 for use with the present invention consists of a tube having a first open end 61 and a second open end 62, and one of said ends being provided with a suction means 63. The suction means can include such things as a flexible bulbous end cap, a flexible bellows, or any other flexible plastic or elastomeric piece which will can be squeezed. In FIG. 8, the suction means is a bulb.

Placed within the tube is a magnet 70. In the embodiment shown in FIG. 8, the magnet 70 is in the shape of a coil, but may also be, for example, loose balls or a rod. In its simplest embodiment, the magnet 70 is simply placed within the dropper tube 60, with no specific attachment to the dropper 50. To prevent the coil from being aspirated into the bulb of the dropper 50 when product is being withdrawn, the end of the coil proximal to the bulb 63 portion of the dropper is fitted with a wire 71 which extends into the bulb 63.

What we claim is:

1. A container for dispensing a fluid cosmetic product to an end user, the container comprising:

a dispensing device having a pump and a conduit for dispensing the fluid cosmetic product, the conduit having a first end and a second end; and at least one magnet positioned on or in said dispensing device such that a magnetic field of said at least one magnet passes through at least a portion of said conduit between said first end and said second end.

2. The container of claim 1, in which the conduit further comprises a dip tube.

3. The container of claim 2 in which the magnet is positioned on the dip tube.

4. The container of claim 3 in which the magnet is a cylinder or bar magnet surrounding the dip tube, a magnet coiled around the dip tube, one or more ring magnets surrounding the dip tube, or a magnetic strip on the dip tube.

5. The container of claim 4 in which the magnet is a ring magnet.

6. The container of claim 4 in which the magnet is enclosed within a casing.

7. The container of claim 6 in which the casing is slidably disposed on the dip tube.

8. The container of claim 2 in which the magnet is positioned at the base of the pump above the dip tube.

9. The container of claim 2 in which the at least one magnet is the dip tube which is formed of a magnetic material.

10. The container of claim 1 wherein the conduit further comprises a dip tube, the dip tube having slidably disposed thereon a casing enclosing a ring magnet.

11. The container of claim 10 which contains a fluid cosmetic product.

12. The container of claim 10 wherein the casing is buoyant such that it is adapted to float on or below the surface of the fluid cosmetic product.

13. A container for dispensing a fluid cosmetic product to an end user, the container comprising:

a dropper assembly comprising a suction means and a conduit, the conduit further comprising a dropper tube for dispensing the fluid cosmetic product, the conduit having a first end and a second end; and at least one magnet positioned on or in said dropper assembly such that a magnetic field of said at least one magnet passes through at least a portion of said conduit between said first end and said second end.

14. The container of claim 13 in which the magnet is positioned inside the dropper tube of the dropper assembly.

15. The container of claim 14 in which the magnet is in the shape of a coil or spiral.

16. The container of claim 15 in which the magnet is equipped with a wire which extends into the suction means of the dropper assembly.

17. The container of claim 13 wherein the at least one magnet is a coil or spiral shaped magnet positioned within the dropper tube, and the magnet is equipped with a wire which extends into the suction means.

18. A dispenser for dispensing a fluid cosmetic product to an end user from a container, the dispenser comprising:

a dispensing device having a pump and a conduit for dispensing the fluid cosmetic product, the conduit having a first end and a second end;

at least one magnet positioned on or in said dispensing device such that a magnetic field of said at least one magnet passes through at least a portion of said conduit between said first end and said second end; and means for attaching said dispenser to the cosmetic container.

* * * * *